US010975452B2

(12) United States Patent
Nishihara et al.

(10) Patent No.: US 10,975,452 B2
(45) Date of Patent: Apr. 13, 2021

(54) HOT FORGED PRODUCT

(71) Applicant: NIPPON STEEL & SUMITOMO METAL CORPORATION, Tokyo (JP)

(72) Inventors: Kison Nishihara, Tokyo (JP); Yoshiyuki Kashiwara, Tokyo (JP); Hiroaki Tahira, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 120 days.

(21) Appl. No.: 16/091,828

(22) PCT Filed: May 20, 2016

(86) PCT No.: PCT/JP2016/065083
§ 371 (c)(1),
(2) Date: Oct. 5, 2018

(87) PCT Pub. No.: WO2017/199442
PCT Pub. Date: Nov. 23, 2017

(65) Prior Publication Data

US 2019/0127817 A1 May 2, 2019

(51) Int. Cl.
*C21D 8/00* (2006.01)
*C21D 9/00* (2006.01)
(Continued)

(52) U.S. Cl.
CPC ..... *C21D 9/0068* (2013.01); *C21D 6/004* (2013.01); *C21D 6/005* (2013.01); *C21D 6/008* (2013.01);
(Continued)

(58) Field of Classification Search
CPC ..... C21D 6/005; C21D 8/00; C21D 8/005; C22C 38/00; C22C 38/38; C22C 38/58
(Continued)

(56) References Cited

U.S. PATENT DOCUMENTS

2009/0304543 A1* 12/2009 Egashira ..... C22C 38/02 420/84

FOREIGN PATENT DOCUMENTS

CN 102808073 A 12/2012
JP 61264129 A 11/1986
(Continued)

OTHER PUBLICATIONS

Int'l. Search Report issued in Int'l. Application No. PCT/JP2016/065083, dated Aug. 23, 2016.

*Primary Examiner* — Jie Yang
(74) *Attorney, Agent, or Firm* — Greer, Burns & Crain, Ltd.

(57) ABSTRACT

There is provided a hot forged product having excellent wear resistance and fatigue strength even when the hot forged product is produced with a thermal refining treatment and a case hardening thermal treatment after hot forging omitted, and having a chemical composition consisting of, in mass %, C: 0.45 to 0.70%, Si: 0.01 to 0.70%, Mn: 1.0 to 1.7%, S: 0.01 to 0.1%, Cr: 0.05 to 0.25%, Al: 0.003 to 0.050%, N: 0.003 to 0.02% with the balance being Fe and impurities. The matrix at the depth of 500 μm to 5 mm from an unmachined surface of the forged product is a ferrite-pearlite structure, in which a pro-eutectoid ferrite area fraction is 3% or less or a pearlite structure, and the average diameter of pearlite colonies in the pearlite structure at the depth of 500 μm to 5 mm from the unmachined surface is 5.0 μm or less.

9 Claims, 7 Drawing Sheets

(51) Int. Cl.

| | |
|---|---|
| ***C22C 38/58*** | (2006.01) |
| ***C22C 38/00*** | (2006.01) |
| ***C21D 6/00*** | (2006.01) |
| ***C22C 38/02*** | (2006.01) |
| ***C22C 38/06*** | (2006.01) |
| ***C22C 38/12*** | (2006.01) |
| ***C22C 38/38*** | (2006.01) |
| ***C22C 38/42*** | (2006.01) |

(52) U.S. Cl.
CPC ..... *C21D 8/00* (2013.01); *C21D 8/005* (2013.01); *C22C 38/00* (2013.01); *C22C 38/001* (2013.01); *C22C 38/002* (2013.01); *C22C 38/02* (2013.01); *C22C 38/06* (2013.01); *C22C 38/12* (2013.01); *C22C 38/38* (2013.01); *C22C 38/42* (2013.01); *C22C 38/58* (2013.01)

(58) Field of Classification Search
USPC ..... 148/332
See application file for complete search history.

(56) References Cited

FOREIGN PATENT DOCUMENTS

| | | | |
|---|---|---|---|
| JP | 09143610 | A | 6/1997 |
| JP | 10226847 | A | 8/1998 |
| JP | 2000328193 | A | 11/2000 |
| JP | 2002256384 | A | 9/2002 |
| JP | 2012001763 | A | 1/2012 |
| JP | 201698409 | A | 5/2016 |

* cited by examiner

HOT FORGED PRODUCT

This is a National Phase Application filed under 35 U.S.C. § 371, of International Application No. PCT/JP2016/065083, filed May 20, 2016, the contents of which are incorporated by reference.

TECHNICAL FIELD

The present invention relates to a hot forged product, and particularly to a hot forged product produced with a thermal refining treatment and a case hardening thermal treatment after hot forging omitted.

BACKGROUND ART

In recent years, a hot forged product produced with a thermal refining treatment omitted (forged crankshaft, for example) has been provided. The thermal refining treatment is hardening and tempering that improve the mechanical characteristics of steel, such as strength. A hot forged product produced with a thermal refining treatment omitted is hereinafter referred to as a non-heat treated hot forged product.

A steel material that forms a non-heat treated hot forged product typically contains vanadium (V). A non-heat treated hot forged product is produced by hot-forging steel and allowing the hot-forged steel to cool in the air. The structure of the steel material that forms a non-heat treated hot forged product is a ferrite-pearlite structure. V in the steel forms minute carbides in the steel during the cooling process after the hot forging, and the minute carbides improve the fatigue strength of the steel. In short, even a thermal refining treatment is omitted, a non-heat treated hot forged product containing V has excellent fatigue strength. A non-heat treated steel containing V for hot forging is disclosed, for example, in Japanese Patent Application Publication No. 09-143610 (Patent Literature 1). The non-heat treated steel disclosed in Patent Literature 1 is formed of a ferrite-pearlite structure, and V precipitates and strengthens ferrite. Patent Literature 1 describes that the fatigue strength of the non-heat treated steel therefore increases.

V is, however, expensive and the production cost of a non-heat treated hot forged product therefore increases. A non-heat treated hot forged product containing no V but having excellent fatigue strength is therefore required.

Japanese Patent Application Publication No. 10-226847 (Patent Literature 2) and Japanese Patent Application Publication No. 61-264129 (Patent Literature 3) each proposes non-heat treated steel for hot forging and a hot forged product containing no V but having high fatigue strength.

The non-heat treated steel disclosed in Patent Literature 2 consists of, in mass %, C: 0.30 to 0.60%, Si: 0.05 to 2.00%, Mn: 0.90 to 1.80%, Cr: 0.10 to 1.00%, s-Al: 0.010 to 0.045%, and N: 0.005 to 0.025% with the balance being Fe and impurities, has post-hot-forging hardness of 30 HRC or less, has a ferrite-plus-pearlite structure, has pearlite lamellar intervals of 0.80 μm or less, and has a pro-eutectoid ferrite area fraction of 30% or less. Patent Literature 2 describes that when non-heat treated steel having the chemical composition described above is hot-forged and allowed to cool in the air, very small pearlite lamellar intervals are achieved, and the pro-eutectoid ferrite area fraction decreases, resulting in an increase in the fatigue strength.

In Patent Literature 3, steel containing, in mass %, C: 0.25 to 0.60%, Si: 0.10 to 1.00%, Mn: 1.00 to 2.00%, and Cr: 0.30 to 1.00% is heated to an $Ac_3$ transformation point or more to 1050° C. or less for hot forging and then cooled into a ferrite-pearlite structure having a pro-eutectoid ferrite quantity F (%) satisfying F≤5-140C % (%) and a pearlite lamellar interval D (μm) satisfying D≤0.20 (μm). Patent Literature 3 describes that an Mn content of at least 1.00% and a Cr content of at least 0.30% allow the pro-eutectoid ferrite quantity F and the pearlite lamellar intervals D to fall within the ranges described above, resulting in excellent balance between the strength and toughness.

A hot forged product also needs to have wear resistance as well as fatigue strength. For example, a crankpin of a crankshaft, which is a hot forged product, is inserted into the large end of a connecting rod. When the crankshaft rotates, the crank pin rotates relative to the inner surface of the large end of the connecting rod via a sliding bearing. The surface of the crankpin therefore needs to have excellent wear resistance.

Japanese Patent Application Publication No. 2000-328193 (Patent Literature 4) and Japanese Patent Application Publication No. 2002-256384 (Patent Literature 5) each discloses non-heat treated steel containing no V but aiming to improve wear resistance.

The non-heat treated steel for hot forging disclosed in Patent Literature 4 has a ferrite-pearlite structure. In the non-heat treated steel for hot forging disclosed in Patent Literature 4, Si and Mn are dissolved in ferrite to reinforce the ferrite. An attempt to improve the wear resistance is thus made.

The non-heat treated steel for crankshaft disclosed in Patent Literature 5 has a structure primarily containing pearlite having a pro-eutectoid ferrite fraction less than 3% and contains sulfide-based inclusions having a thickness of 20 μm or less. Further, the Si content is 0.60% or less, and the Al content is less than 0.005%. Wear resistance and machinability are thus improved.

To improve the wear resistance of a hot forged product, the hot forged product typically undergoes a case hardening thermal treatment. The case hardening thermal treatment is, for example, induction hardening or nitriding. The induction hardening forms a hardened layer on the surface of the hot forged product. The nitriding forms a nitride layer on the surface of the hot forged product. The hardened layer and the nitride layer have high hardness. The wear resistance of the surface of the hot forged product is therefore improved.

Performing the case hardening thermal treatment, however, increases the production cost. It is therefore required to provide a non-heat treated hot forged product containing no V but having excellent wear resistance even when the hot forged product is produced with the case hardening thermal treatment omitted.

The wear resistance of a hot forged product produced by using the non-heat treated steel disclosed in any of Patent Literatures 2 to 5 is likely to decrease when the case hardening thermal treatment is omitted.

Japanese Patent Application Publication No. 2012-1763 (Patent Literature 6) describes a forged crankshaft having excellent wear resistance even when the crankshaft has undergone no thermal refining treatment or case hardening thermal treatment after hot forging.

The forged crankshaft disclosed in Patent Literature 6 is made of a non-heat treated steel material that satisfies 1.1C+Mn+0.2Cr>2.0 (in the expression, into the symbol of each of the elements is substituted the content (mass %) of the element) and has a ferrite-pearlite structure having a pro-eutectoid ferrite area fraction less than 10% or a pearlite structure.

Patent Literature 6, however, does not examine the fatigue strength.

CITATION LIST

Patent Literature

Patent Literature 1: Japanese Patent Application Publication No. 09-143610

Patent Literature 2: Japanese Patent Application Publication No. 10-226847

Patent Literature 3: Japanese Patent Application Publication No. 61-264129

Patent Literature 4: Japanese Patent Application Publication No. 2000-328193

Patent Literature 5: Japanese Patent Application Publication No. 2002-256384

Patent Literature 6: Japanese Patent Application Publication No. 2012-1763

SUMMARY OF INVENTION

An object of the present invention is to provide a hot forged product having excellent wear resistance and fatigue strength even when the hot forged product is produced with a thermal refining treatment and a case hardening thermal treatment after hot forging omitted.

A hot forged product according to an embodiment of the present invention has a chemical composition consisting of, in mass %, C: 0.45 to 0.70%, Si: 0.01 to 0.70%, Mn: 1.0 to 1.7%, S: 0.01 to 0.1%, Cr: 0.05 to 0.25%, Al: 0.003 to 0.050%, N: 0.003 to 0.02%, Ca: 0 to 0.01%, Cu: 0 to 0.15%, and Ni: 0 to 0.15% with the balance being Fe and impurities. A matrix at a depth of 500 μm to 5 mm from an unmachined surface of the forged product is a ferrite-pearlite structure, in which a pro-eutectoid ferrite area fraction is 3% or less or a pearlite structure, and an average diameter of pearlite colonies in the pearlite structure at the depth of 500 μm to 5 mm from the unmachined surface is 5.0 μm or less.

A hot forged product according to the embodiment of the present invention has excellent wear resistance and fatigue strength even when the hot forged product is produced with a thermal refining treatment and a case hardening thermal treatment after hot forging omitted.

DESCRIPTION OF EMBODIMENTS

Figure 1:
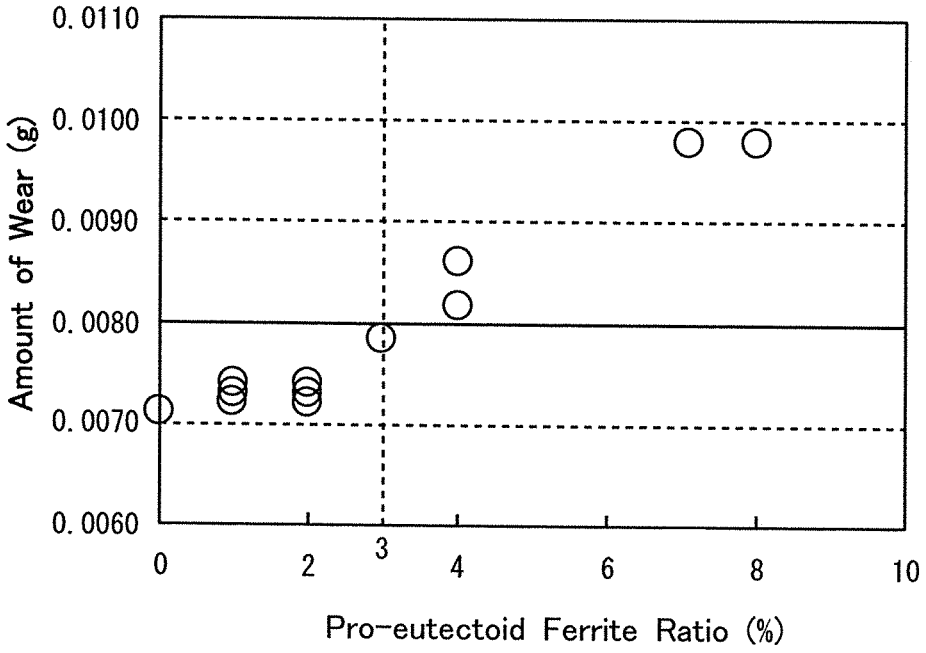
FIG. 1 shows graphs representing the relationship between a pro-eutectoid ferrite ratio and wear resistance.

An embodiment of the present invention will be described below in detail with reference to the drawings. In the following drawings, the same or corresponding portions have the same reference character and will not be repeatedly described.

Overview of Hot Forged Product According to Present Embodiment

The present inventors have conducted investigation and examination to improve the wear resistance and fatigue strength of a hot forged product produced with a thermal refining treatment and a case hardening thermal treatment omitted. As a result, the present inventors have obtained the following findings:

(A) A hot forged product has excellent wear resistance when the matrix in a machined surface has a ferrite-pearlite structure, in which a small pro-eutectoid ferrite area fraction or a pearlite structure. Bainite and martensite have poor wear resistance as compared with a ferrite-pearlite structure or a pearlite structure. The "pro-eutectoid ferrite" means ferrite that precipitates from austenite before eutectoid transformation when steel is cooled. The "ferrite-pearlite structure" means a structure formed of pro-eutectoid ferrite and pearlite, and the "pearlite structure" means a structure, in which a pro-eutectoid ferrite area fraction is 0% and being substantially of a pearlite single phase. In the following description, the pro-eutectoid ferrite area fraction is called a "pro-eutectoid ferrite ratio."

Pro-eutectoid ferrite is softer than pearlite and has low wear resistance. Therefore, when the pro-eutectoid ferrite ratio is a predetermined value or less, a hot forged product has excellent wear resistance.

FIG. 1 shows graphs representing the relationship between the pro-eutectoid ferrite ratio and the wear resistance of hot forged products each having a ferrite-pearlite structure or a pearlite structure. FIG. 1 was obtained by the following method: A variety of hot forged products having different chemical compositions were produced under different production conditions by changing the chemical composition and cooling condition after the hot forging. Test specimens for wear resistance investigation were collected from the produced hot forged products. Wear resistance investigation was performed to measure the amount of wear of each of the test specimens. The abscissa of FIG. 1 represents the pro-eutectoid ferrite ratio of the structure of the hot forged products. The chemical compositions of the hot forged products, the cooling conditions after the hot forging, a method for measuring the pro-eutectoid ferrite ratio, and the wear resistance investigation will be described later in detail.

The amount of wear is 0.0080 g or less when the pro-eutectoid ferrite ratio is 3% or less, as shown in FIG. 1.

(B) In the ferrite-pearlite structure or the pearlite structure described above, the fatigue strength of the hot forged products increases when the pearlite colonies in the pearlite structure each has a small size.

The pearlite structure has a lamellar structure in which ferrite and cementite are laminarly arranged. In the pearlite structure, a region where the ferrite has roughly the same crystal orientation is called a pearlite block. In the pearlite block, a region where the ferrite has a more aligned crystal orientation is called a pearlite colony.

In the present specification, in the pearlite structure, a region surrounded by the boundary out of which the difference in the ferrite crystal orientation is 15° or more is defined as the pearlite block. In other words, in a single pearlite block, the difference in the ferrite crystal orientation is less than 15°. Further, in the pearlite structure, a region surrounded by the boundary out of which the difference in the ferrite crystal orientation is 2° or more but less than 15° is defined as the pearlite colony. In other words, in a single pearlite colony, the difference in the ferrite crystal orientation is less than 2°.

Figure 2:
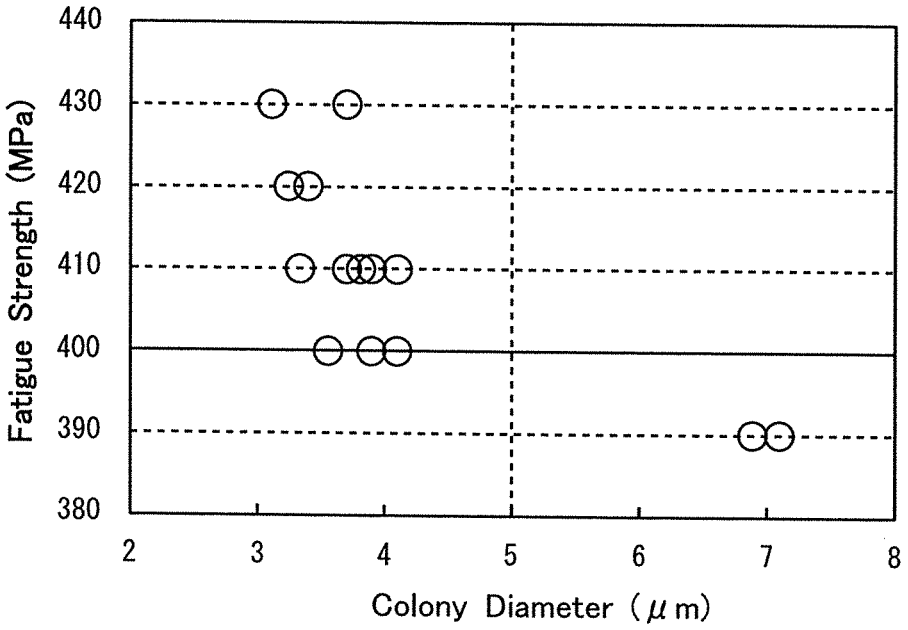
FIG. 2 shows graphs representing the relationship between the size of a pearlite colony and fatigue strength.

FIG. 2 shows graphs representing the relationship between the size of the pearlite colonies and the fatigue strength of hot forged products that satisfy the chemical composition described later and have the ferrite-pearlite structure or the pearlite structure. FIG. 2 was obtained as follows: A variety of hot forged products were produced as in the same manner described with reference to FIG. 1. Rotating bending fatigue test specimens were collected from the produced hot forged products. A fatigue test was performed to measure the fatigue strength of each of the rotating bending fatigue test specimens. The abscissa of FIG. 2 represents the average diameter of the pearlite colonies in the structure of the hot forged products. The diameter of a pearlite colony is the diameter of a circle the area of which is equal to the area of the pearlite colony (diameter of equivalent circle). The average diameter of a pearlite colony is hereinafter referred to as a colony diameter. A method for measuring the area of a pearlite colony and the fatigue test will be described later in detail.

When the colony diameter decreases, the fatigue strength increases, as shown in FIG. 2. The smaller the colony diameter, the greater the total length of the boundaries between the pearlite colonies. An increase in the total length of the boundaries is believed to suppress extension of fatigue cracking.

When the colony diameter is 5.0 μm or less, the fatigue strength is 400 MPa or more, as shown in FIG. 2.

(C) The colony diameter can be controlled by the chemical composition and the cooling rate after the hot forging. When the cooling rate after the hot forging increases, the colony diameter decreases, and the fatigue strength of a hot forged product therefore increases. On the other hand, the cooling rate after the hot forging is too high, martensite and bainite are formed in a surface structure of the hot forged product, resulting in an excessive increase in the hardness of the surface of the hot forged product. A hot forged product is machined in some cases. When the surface hardness increases due to the formation of martensite and bainite, the machinability of the hot forged product decreases.

A hot forged product according to the present embodiment attained based on the findings described above has a chemical composition consisting of, in mass %, C: 0.45 to 0.70%, Si: 0.01 to 0.70%, Mn: 1.0 to 1.7%, S: 0.01 to 0.1%, Cr: 0.05 to 0.25%, Al: 0.003 to 0.050%, N: 0.003 to 0.02%, Ca: 0 to 0.01%, Cu: 0 to 0.15%, and Ni: 0 to 0.15% with the balance being Fe and impurities. The matrix at the depth of 500 μm to 5 mm from an unmachined surface of the forged product is a ferrite-pearlite structure, in which a pro-eutectoid ferrite area fraction is 3% or less or a pearlite structure, and the average diameter of the pearlite colonies in the pearlite structure at the depth of 500 μm to 5 mm from the unmachined surface is 5.0 μm or less.

The chemical composition described above may contain Ca: 0.0005 to 0.01%.

The chemical composition described above may contain at least one type selected from the group consisting of Cu: 0.02 to 0.15% and Ni: 0.02 to 0.15%.

The hot forged product according to the present embodiment is, for example, a crankshaft.

The hot forged product according to the present embodiment will be described below in detail.

Configuration of Hot Forged Product

Figure 3:
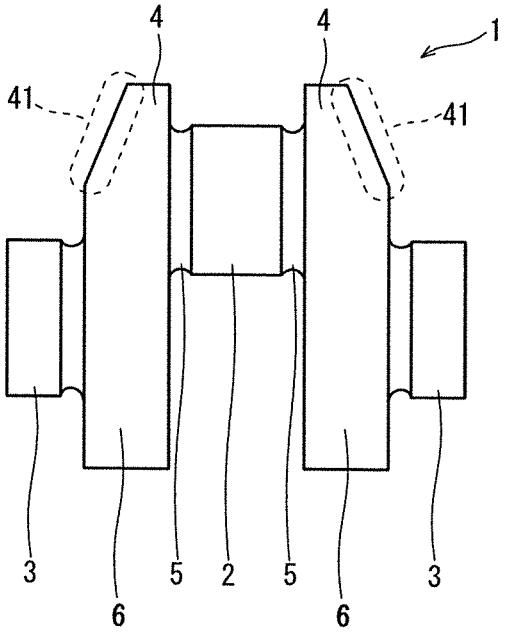
FIG. 3 shows key parts of a crankshaft that is an example of a hot forged product.

FIG. 3 shows key parts of a crankshaft 1, which is an example of the hot forged product according to the present embodiment. The crankshaft 1 includes a crankpin 2, crank journals 3, crankarms 4, and counter weights 6. The crankarms 4 are each disposed between the crankpin 2 and the corresponding crank journal 3 and connected to the crankpin 2 and the crank journals 3. The counter weights 6 are connected to the crankarms 4. The crankshaft 1 further includes fillet sections 5. The fillet sections 5 each corresponds to the joint between the crankpin 2 and the corresponding crankarm 4.

The crankpin 2 is attached to be rotatable relative to a connecting rod that is not shown. The crankpin 2 is disposed so as to be shifted from the axis of rotation of the crankshaft 1. The crank journals 3 are disposed coaxially with the axis of rotation of the crankshaft 1.

The crankpin 2 is inserted into the large end of the connecting rod. When the crankshaft rotates, the crankpin 2 rotates relative to the inner surface of the large end of the connecting rod via a sliding bearing. The surface of the crankpin 2 therefore needs to have wear resistance.

The surface of the crankshaft 1 has a machined portion and an unmachined portion (portion where machining is omitted). For example, side surface portions 41 of the crankarms 4 are not machined in some cases. The surfaces of the counter weights 6 are also not machined in some cases.

As described above, a typical hot forged product undergoes the case hardening thermal treatment. The case hardening thermal treatment is, for example, induction hardening or nitriding. The case hardening thermal treatment hardens the surface of the crankpin and therefore improves the wear resistance thereof.

In the case of the crankshaft 1 according to the present embodiment, however, the crankpin 2 undergoes no case hardening thermal treatment. The production cost therefore decreases. The crank journals 3 may also undergo no case hardening thermal treatment as well as the crankpin 2, or the entire crankshaft 1 may undergo no case hardening thermal treatment.

The hot forged product according to the present embodiment includes what is called an intermediate product before machining (hot forged product the entire surface of which has been unmachined) and a hot forged product that is the final product after machining (hot forged product part of the surface of which has been unmachined but the remainder of the surface of which has been machined).

Chemical Composition

The hot forged product according to the present embodiment has the chemical composition shown below. The symbol % associated with an element means mass % unless otherwise noted.

C: 0.45 to 0.70%

Carbon (C) lowers the pro-eutectoid ferrite ratio in the steel but increases the pearlite area fraction in the steel. As a result, the strength and hardness of the steel increase, and the wear resistance also increases. Too low a C content results in too high a pro-eutectoid ferrite ratio in the steel structure. On the other hand, too high a C content causes the steel to excessively harden, resulting in a decrease in the machinability of the steel. The C content therefore ranges from 0.45 to 0.70%. The lower limit of the C content is preferably 0.48%, more preferably 0.50%. The upper limit of the C content is preferably 0.60%, more preferably 0.58%.

Si: 0.01 to 0.70%

Silicon (Si) is dissolved in the ferrite in the pearlite to reinforce the ferrite. Si therefore increases the strength and hardness of the steel. Si further deoxidizes the steel. Too low a Si content results in decreases in strength and hardness of the steel. On the other hand, too high a Si content results in decarburization of the steel at the time of hot forging. In this case, the machining margin after the hot forging increases. The Si content therefore ranges from 0.01 to 0.70%. The lower limit of the Si content is preferably 0.20%. The upper limit of the Si content is preferably 0.65%.

Mn: 1.0 to 1.7%

Manganese (Mn) is dissolved in the steel to increase the strength and hardness of the steel. Mn further suppresses formation of the pro-eutectoid ferrite. Too low a Mn content results in too high a pro-eutectoid ferrite ratio. Further, too low a Mn content does not allow an increase in the strength and hardness of the steel. On the other hand, too high a Mn content forms martensite and bainite. Martensite and bainite lower the wear resistance and machinability of the steel. Formation of martensite and bainite is therefore unpreferable. The Mn content therefore ranges from 1.0 to 1.7%. The lower limit of the Mn content is preferably 1.2%, more preferably 1.3%. The upper limit of the Mn content is preferably 1.65%, more preferably 1.6%.

S: 0.01 to 0.1%

Sulphur (S) forms a sulfide, such as MnS, and therefore increases the machinability of the steel. On the other hand, too high an S content lowers the hot workability of the steel. The S content therefor ranges from 0.01 to 0.1%. The lower limit of the S content is preferably 0.03%, more preferably 0.04%. The upper limit of the S content is preferably 0.07%, more preferably 0.06%.

Cr: 0.05 to 0.25%

Chromium (Cr) increases the strength and hardness of the steel. Cr further suppresses formation of the pro-eutectoid ferrite in the steel. Too low a Cr content results in too high a pro-eutectoid ferrite ratio. On the other hand, too high a Cr content forms martensite and bainite. The Cr content therefore ranges from 0.05 to 0.25%. The lower limit of the Cr content is preferably 0.08%, and the upper limit of the Cr content is preferably 0.20%.

Al: 0.003 to 0.050%

Aluminum (Al) deoxidizes the steel. Al further forms a nitride to prevent the crystal grains from coarsening. Al therefore suppresses significant decreases in the strength, hardness, and toughness of the steel. On the other hand, too high an Al content forms an $Al_2O_3$ inclusion. The $Al_2O_3$ inclusion lowers the machinability of the steel. The Al content therefore ranges from 0.003 to 0.050%. The lower limit of the Al content is preferably 0.010%, and the upper limit of the Al content is preferably 0.040%. The Al content in the present embodiment is the content of acid-soluble Al (Sol.Al).

N: 0.003 to 0.02%

Nitrogen (N) forms a nitride and a carbo-nitride. A nitride and a carbo-nitride prevent the crystal grains from coarsening and therefore prevent significant decreases in the strength, hardness, and toughness of the steel. On the other hand, too high a N content tends to allow creation of voids or any other defect in the steel. The N content therefore ranges from 0.003 to 0.02%. The lower limit of the N content is preferably 0.005%, more preferably 0.008%, still more preferably 0.012%. The upper limit of the N content is preferably 0.018%.

The balance of the chemical composition of the hot forged product is formed of Fe and impurities. The impurities refer to ores and scraps used as raw materials of the steel or contaminant elements from the environment of production processes. The impurities are, for example, phosphor (P) and oxygen (O).

The chemical composition of the hot forged product according to the present embodiment may further contain Ca in place of part of Fe.

Ca: 0 to 0.01%

Calcium (Ca) is an optional element and may not be contained. When contained, Ca increases the machinability of the steel. Specifically, an Al-based oxide contains Ca, which lowers the fusing point of the steel. Ca therefore increases the machinability of the steel at the time of high-temperature machining. Too high a Ca content, however, lowers the toughness of the steel. The Ca content therefore ranges from 0 to 0.01%. The lower limit of the Ca content is preferably 0.0005%.

The chemical composition of the hot forged product according to the present embodiment may further contain at least one type selected from the group consisting of Cu and Ni in place of part of Fe. The elements are each dissolved in the steel to strengthen the steel.

Cu: 0 to 0.15%,

Ni: 0 to 0.15%

Copper (Cu) and nickel (Ni) are each an optional element and may not be contained. When contained, Cu and Ni are dissolved in the steel to contribute to strengthening of the steel. Too high a Cu content, however, improves hardenability of the steel and tends to create a bainite structure or a martensite structure. Too high a Ni content also improves hardenability of the steel and tends to create a bainite structure or a martensite structure. Therefore, the Cu content ranges from 0 to 0.15%, and the Ni content ranges from 0 to 0.15%. The lower limit of the Cu content is preferably 0.02%. The lower limit of the Ni content is preferably 0.02%.

Structure

The matrix at the depth of 500 μm to 5 mm from an unmachined surface out of the surface of the hot forged product is the ferrite-pearlite structure, in which a pro-eutectoid ferrite ratio is 3% or less or the pearlite structure. The range from 500 μm to 5 mm separate from an unmachined surface out of the surface of the hot forged product is hereinafter referred to as a "surface region."

The matrix in the surface region may be the ferrite-pearlite structure, in which a pro-eutectoid ferrite ratio is 3% or less or the pearlite structure, in which a pro-eutectoid ferrite ratio is 0%. Bainite and martensite have poor wear resistance as compared with the ferrite-pearlite structure or the pearlite structure.

The pro-eutectoid ferrite area fraction (pro-eutectoid ferrite ratio) is now defined as follows: A specimen used for microstructure observation and having an observation surface located in the surface region of the hot forged product is first collected. The observation surface of the specimen is mirror-polished and etched with a nital etching reagent. Within the observation surface, 20 fields of view each having an area of 0.03 $mm^2$ (150 μm×200 μm/field of view) are observed. Image processing is performed on the resultant micrographs to determine the pro-eutectoid ferrite area fraction in each of the fields of view, and the average of the determined pro-eutectoid ferrite area fractions is used as the pro-eutectoid ferrite area fraction.

When the matrix in the surface region is the ferrite-pearlite structure, in which a pro-eutectoid ferrite area fraction is 3% or less or the pearlite structure, the wear resistance of the hot forged product increases. The pro-eutectoid ferrite area fraction is preferably less than 3%.

Further, in the hot forged product, the pearlite colonies in the ferrite-pearlite structure or the pearlite structure in the surface region of the hot forged product have an average diameter (colony diameter) of 5.0 μm or less.

The colony diameter is now defined as follows: A test specimen having an observation surface located in the surface region of the hot forged product is collected. Electron beam diffraction images of the test specimen are acquired with an electron microscope Quanta (product name) produced by FEI and an EBSD electron beam backscatter diffraction (EBSD) apparatus HKL (product name) produced by Oxford Instruments. The boundaries of the pearlite colonies in the structure are determined from the electron beam diffraction images. The area of each of the pearlite colonies is calculated from the boundaries of the pearlite colonies. The diameter of the pearlite colony (diameter of equivalent circle) is determined from the calculated area. The diameter of each of the pearlite colonies is determined at each of four locations of the test specimen that correspond to the surface region of the hot forged product, and the average of the determined diameters is used as the colony diameter. In the pearlite structure, it is assumed that a region surrounded by a boundary inside of which the difference in the ferrite orientation is 2° or more to less than 15° is a pearlite colony.

When the colony diameter is small, the total length of boundaries of the pearlite colonies increases. An increase in the total length of the boundaries suppresses propagation of fatigue cracking and therefore increases the fatigue strength of the hot forged product.

The hot forged product according to the present embodiment has the structure described above in the surface region and therefore has excellent wear resistance and fatigue strength even when the hot forged product is produced with the case hardening thermal treatment omitted.

Production Method

An example of a method for producing the hot forged product will be described.

Molten steel having the chemical composition described above is produced. The molten steel is converted into a cast piece in a continuous casting process. The molten steel may be converted into an ingot in an ingot-making process. The cast piece or the ingot is hot-worked into a billet or a steel bar.

The cast piece, ingot, billet, or steel bar is heated in a heating furnace. The heating temperature is preferably 1200° C. or more. The heated cast piece, ingot, billet, or steel bar is hot-forged to produce an intermediate product. The finishing temperature of the hot forging is preferably 900° C. or more.

The intermediate product after the hot forging is cooled in a controlled manner at a predetermined rate. Specifically, the cooling rate employed when the surface temperature of the intermediate product ranges from 800 to 500° C. is set at a value ranging from 100 to 300° C. per minute. If the cooling rate is too low, a pearlite colony increases and therefore high fatigue strength cannot be acquired. Further, if the cooling rate is too low, the pro-eutectoid ferrite ratio increases. On the other hand, if the cooling rate is too high, martensite and bainite are formed. The cooling rate employed when the surface temperature of the intermediate product ranges from 800 to 500° C. is therefore a value ranging from 100 to 300° C. per minute.

The cooling can be achieved, for example, by mist cooling using a mixed fluid that is a mixture of air and water, intense air cooling using compressed air, or intense air cooling using a blower. Arbitrary cooling rates can be employed in the temperature range more than 800° C. and the temperature range less than 500° C.

A hot forged product that is the intermediate product is thus produced. When steel having the chemical composition described above is hot-forged and cooled at the cooling rate described above, the matrix in the surface region of the hot forged product has the ferrite-pearlite structure, in which a pro-eutectoid ferrite area fraction is 3% or less or the pearl ite structure. Further, the colony diameter in the pearlite structure in the surface region is 5.0 μm or less. The hot forged product described above undergoes no thermal refining treatment and is therefore a non-heat treated hot forged product.

Part of the surface of the hot forged product described above is machined in mechanical working to produce the crankshaft 1, which is a hot forged product as the final product. The thickness of the portion removed from the crankshaft 1 in the machining (cutting margin) ranges from about 500 μm to 5 mm measured from the surface of the hot forged product as the intermediate product described above. Therefore, to achieve a structure, such as that described above, in the portion at the depth of about several millimeters from the surface of the crankshaft 1 after the machining, the matrix at the depth of 500 μm to 5 mm from the surface in the hot forged product (intermediate product) before the machining only needs to be the ferrite-pearlite structure, in which a pro-eutectoid ferrite ratio is 3% or less or the pearlite structure. Similarly, the colony diameter in the pearlite structure at the depth of 500 μm to 5 mm from the surface in the hot forged product before the machining only needs to be 5.0 μm or less.

The surface of the produced crankshaft 1 has an unmachined portion. The matrix at the depth of 500 μm to 5 mm from the surface of the unmachined portion is the ferrite-pearlite structure, in which a pro-eutectoid ferrite ratio is 3% or less or the pearlite structure, and the colony diameter in the pearlite structure at the depth of 500 μm to 5 mm from the surface of the unmachined portion is 5.0 μm or less.

At least the crankpin 2 out of the produced crankshaft 1 undergoes no case hardening thermal treatment. That is, no induction hardening or nitriding is performed on the surface of the crankpin 2. The fillet sections 5 may undergo fillet rolling processing so that the resultant work hardening increases the surface hardness of the fillet sections 5. In the fillet rolling processing, rollers are pressed against the surfaces of the fillet sections 5 with the hot forged product 1 rotated. The surfaces of the fillet sections 5 are plastically deformed and therefore undergo work hardening. The fillet sections 5 may instead undergo no fillet rolling processing.

In the hot forged product produced by carrying out the steps described above, even when it is the intermediate product or the final product (crankshaft 1), the matrix at the depth of 500 μm to 5 mm from the unmachined surface is the ferrite-pearlite structure, in which a pro-eutectoid ferrite ratio is 3% or less or the pearlite structure. Further, the colony diameter in the pearlite structure at the depth of 500 μm to 5 mm from the surface is 5.0 μm or less.

The matrix in the machined surface out of the surface of the hot forged product as the final product is the ferrite-pearlite structure, in which a pro-eutectoid ferrite ratio is 3% or less or the pearlite structure, and the colony diameter in the pearlite structure in the surface is 5.0 μm or less.

The hot forged product according to the present embodiment, which has the structure described above and contains no V, has excellent wear resistance and fatigue strength even when the hot forged product is produced with the thermal refining treatment and the case hardening thermal treatment omitted. Further, since the hot forged product according to the present embodiment has an adequate Si content, the depth of the decarburized layer formed in the surface of the hot forged product that is the intermediate product can be reduced. Therefore, the machining margin of the hot forged product after the hot forging can be reduced.

EXAMPLES

Steel materials having the chemical compositions shown in Table 1 (test numbers 1 to 7 and a to i) were melted in a vacuum induction heating furnace into molten steel materials. The molten steel materials underwent an ingot-making process to produce columnar ingots. The produced ingots each had a weight of 25 kg and an outer diameter of 75 mm.

TABLE 1

| Test | Chemical composition (unit: mass %, balance being Fe and impurities) | | | | | | | | | | | Cooling rate |
|---|---|---|---|---|---|---|---|---|---|---|---|---|
| number | C | Si | Mn | S | Cr | Al | N | V | Ca | Cu | Ni | (° C./min) |
| 1 | 0.65 | 0.28 | 1.01 | 0.070 | 0.10 | 0.029 | 0.0034 | — | — | — | — | 150 |
| 2 | 0.54 | 0.55 | 1.47 | 0.095 | 0.12 | 0.036 | 0.0045 | — | — | — | — | 150 |
| 3 | 0.59 | 0.22 | 1.47 | 0.097 | 0.12 | 0.035 | 0.0058 | — | — | — | — | 250 |
| 4 | 0.53 | 0.56 | 1.52 | 0.049 | 0.12 | 0.005 | 0.0042 | — | 0.0035 | — | — | 150 |
| 5 | 0.55 | 0.69 | 1.21 | 0.062 | 0.11 | 0.032 | 0.0067 | — | — | — | — | 150 |
| 6 | 0.53 | 0.51 | 1.39 | 0.061 | 0.09 | 0.033 | 0.0064 | — | — | 0.03 | — | 150 |
| 7 | 0.56 | 0.54 | 1.48 | 0.058 | 0.12 | 0.029 | 0.0081 | — | — | 0.05 | 0.03 | 150 |
| a | 0.47 | 0.54 | 0.90 | 0.054 | 0.12 | 0.039 | 0.0092 | 0.084 | — | — | — | 120 |
| b | 0.39 | 0.58 | 1.48 | 0.067 | 0.12 | 0.003 | 0.0191 | — | — | — | — | 150 |
| c | 0.38 | 0.33 | 0.86 | 0.012 | 1.19 | 0.040 | 0.0082 | — | — | — | — | 150 |
| d | 0.49 | 0.94 | 1.50 | 0.064 | 0.10 | 0.012 | 0.0072 | — | — | — | — | 150 |
| e | 0.59 | 0.22 | 1.47 | 0.097 | 0.12 | 0.035 | 0.0058 | — | — | — | — | 350 |
| f | 0.54 | 0.55 | 1.47 | 0.095 | 0.12 | 0.036 | 0.0045 | — | — | — | — | 30 |
| g | 0.55 | 0.54 | 1.50 | 0.064 | 0.31 | 0.016 | 0.0087 | — | — | — | — | 150 |
| h | 0.55 | 0.53 | 0.80 | 0.055 | 0.13 | 0.032 | 0.0084 | — | — | — | — | 150 |
| i | 0.55 | 0.53 | 1.82 | 0.091 | 0.19 | 0.031 | 0.0090 | — | — | — | — | 150 |

The fields of symbol of an element in Table 1 show the contents (mass %) of the corresponding elements. In Table 1, "-" represents that the content of the corresponding element is an impurity level. The balance of each of the steel materials was Fe and impurities.

The ingots produced from the steel materials were hot-forged to produce forged products. Specifically, the ingots were heated to 1250° C. in a heating furnace. The heated ingots were hot-forged to produce round-bar-shaped forged products each having an outer diameter of 15 mm (hereinafter simply each referred to as round bar). The finishing temperature in the hot forging was 950° C.

After the hot forging, the round bars were cooled to room temperature (23° C.) at the cooling rates shown in Table 1. The cooling rates (° C./min) employed when the surface temperature ranges from 800 to 500° C. were those shown in Table 1. Specifically, mist cooling was performed on the test numbers 1 to 7, b, c, d, e, g, h, and i over the temperature range from 800 to 500° C. Air cooling using a blower was performed on the test number a over the temperature range from 800 to 500° C. Cooling in the air was performed on the test number f over the temperature range from 800 to 500° C.

Microstructure Investigation

Figure 4:
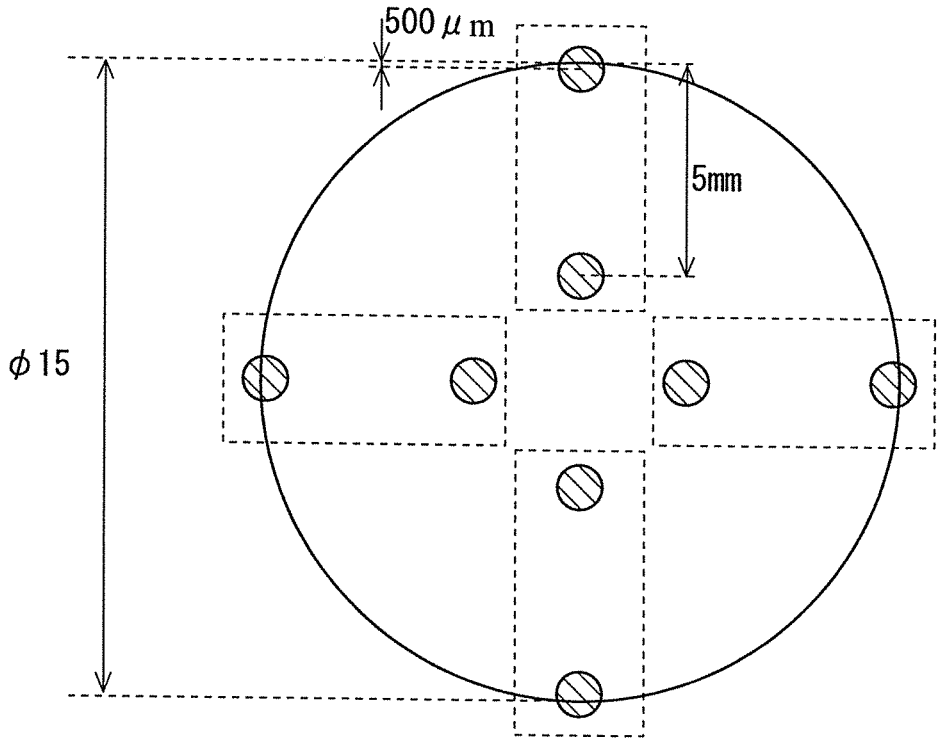
FIG. 4 describes microstructure collection positions in a cross section of each round bar and observation positions in microstructure investigation.

Micro-specimens were collected from the round bars, and the structure of each of the micro-specimens was observed. FIG. 4 describes microstructure collection positions in a cross section of each of the round bars and observation positions in the microstructure investigation. From each of the round bars, four micro-specimens separate from each other by 90° and including the surface of the round bar were collected, as indicated by the chain lines in FIG. 4.

The surface of each of the micro-specimens was mirror-polished, and the polished surface was etched with a nital etching reagent. The etched surfaces were observed under an optical microscope at a magnification of 400.

As shown in FIG. 4, each of the micro-specimens was observed as follows: In the depth position separate from the surface of the round bar by 500 μm and the depth position separate from the surface by 5 mm, that is, in the positions enclosed with the circles, 5 fields of view at one location, 20 fields of view in total each having an area of 0.03 $mm^2$ (150 μm×200 μm/field of view) were observed. Image processing was performed on the resultant micrograph of each of the fields of view to determine the pro-eutectoid ferrite area fraction in the field of view. The average of the pro-eutectoid ferrite area fractions in the 20 fields of view observed in the depth position separate from the surface by 500 μm was used as the pro-eutectoid ferrite ratio in the depth position separate from the surface of the micro-specimen by 500 μm. The average of the pro-eutectoid ferrite area fractions in the 20 fields of view observed in the depth position separate from the surface by 5 mm was used as the pro-eutectoid ferrite ratio in the depth position separate from the surface of the micro-specimen by 5 mm.

Pearlite Colony Investigation

An EBSD apparatus was used to measure the colony diameter in the pearlite structure in each of the observation positions of each of the micro-specimens. More specifically, an electron beam diffraction image was acquired with the electron microscope Quanta (product name) produced by FEI and the EBSD analyzer HKL (product name) produced by Oxford Instruments. The crystal orientation and other factors were analyzed from the electron beam diffraction image to determine the boundaries of the pearlite colonies, and the area of each of the pearlite colonies was calculated based on the determined boundaries. The analysis was performed by using HKL (product name).

The colony diameter in each of the micro-specimens was measured in the depth position separate from the surface by 500 μm and the depth position separate from the surface by 5 mm, as in the microstructure investigation. The beam diameter of the electron beam was 1 μm, a single mapping region has a size of 100 μm×200 μm, and the average of the diameters of the colonies in four mapping regions was used as the colony diameter.

Surface Hardness Investigation

The hardness of the cross-section of each of the round bars was measured by using the micro-specimens in a Vickers hardness test compliant with JIS Z2244 (2009). The test force was set at 98.07 N (10 kgf). For each of the micro-specimens, the hardness was measured at 5 locations separate from the surface of the round bar toward the interior thereof at 1-mm intervals, and the average of the hardness values was defined as the average hardness of the micro-specimen.

Fatigue Strength Investigation

Figure 5:
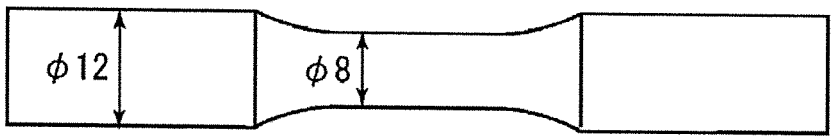
FIG. 5 is a diagrammatic view of a rotating bending fatigue test specimen collected from each of the round bars.

A rotating bending fatigue test specimen was collected from each of the round bars. FIG. 5 is a diagrammatic view of the rotating bending fatigue test specimen collected from each of the round bars. The rotating bending test specimen was formed of a parallel section having a diameter of 8 mm and grip sections each having a diameter of 12 mm. The rotating bending fatigue strength test specimen was created such that the center axis of the rotating bending fatigue test specimen coincided with the center axis of the round bar. Specifically, the round bar was cut from the surface thereof to a depth of 3.5 mm in lathe working to create the parallel section. The surface of the parallel section therefore at least corresponded to a surface that falls within a depth range of 5 mm from the surface of the round bar. That is, the rotating bending fatigue strength test specimen was assumed to be an equivalent of the crankshaft 1 after the intermediate product was machined.

Finishing polishing was performed on the parallel section of the rotating bending fatigue strength test specimen to adjust the surface roughness. Specifically, the polishing was performed such that the center line average roughness (Ra) of the surface of the parallel section was 3.0 μm or less, and the maximum roughness height (Rmax) was 9.0 μm or less.

Ono type rotating bending fatigue test was performed on the rotating bending fatigue strength test specimen having undergone the finishing polishing at room temperature (23° C.) in the atmosphere under the condition that fully-reversed tension-compression was performed at the number of revolution of 3600 rpm. The fatigue test was performed on a plurality of test specimens with the stress induced therein changed, and the highest stress that did not result in fracture of the test specimen after $10^7$ cycles of the stress application was used as the fatigue strength (MPa).

Wear Resistance Investigation

Test specimens for wear resistance investigation each having a size of 1.5 mm×2.0 mm×3.7 mm were collected in such a way that the position separate from the surface of each of the round bars by a depth ranging from 500 to 1000 μm coincided with the center of the principal surface of each of the test specimens that is described below. The 2.0-mm-by-3.7-mm surface of each of the test specimens (hereinafter referred to as principal surface) was parallel to the cross section of the round bar. That is, a normal to the principal surface of each of the test specimens was parallel to the center axis of the round bar.

A pin-on-disk wear test using an automatic polisher was performed on each of the test specimens. Specifically, 800-grit emery paper was attached to the surface of the rotating disc of the automatic polisher. The principal surface of each of the test specimens was pressed against the emery paper with a surface pressure of 26 gf/mm$^2$, and the rotating disc was rotated at a peripheral speed of 39.6 m/min for 50 minutes. After the rotation for 50 minutes, the difference in weight of the test specimen between before and after the test was defined as the amount of wear (g).

Decarburization Depth Investigation

Figure 6:
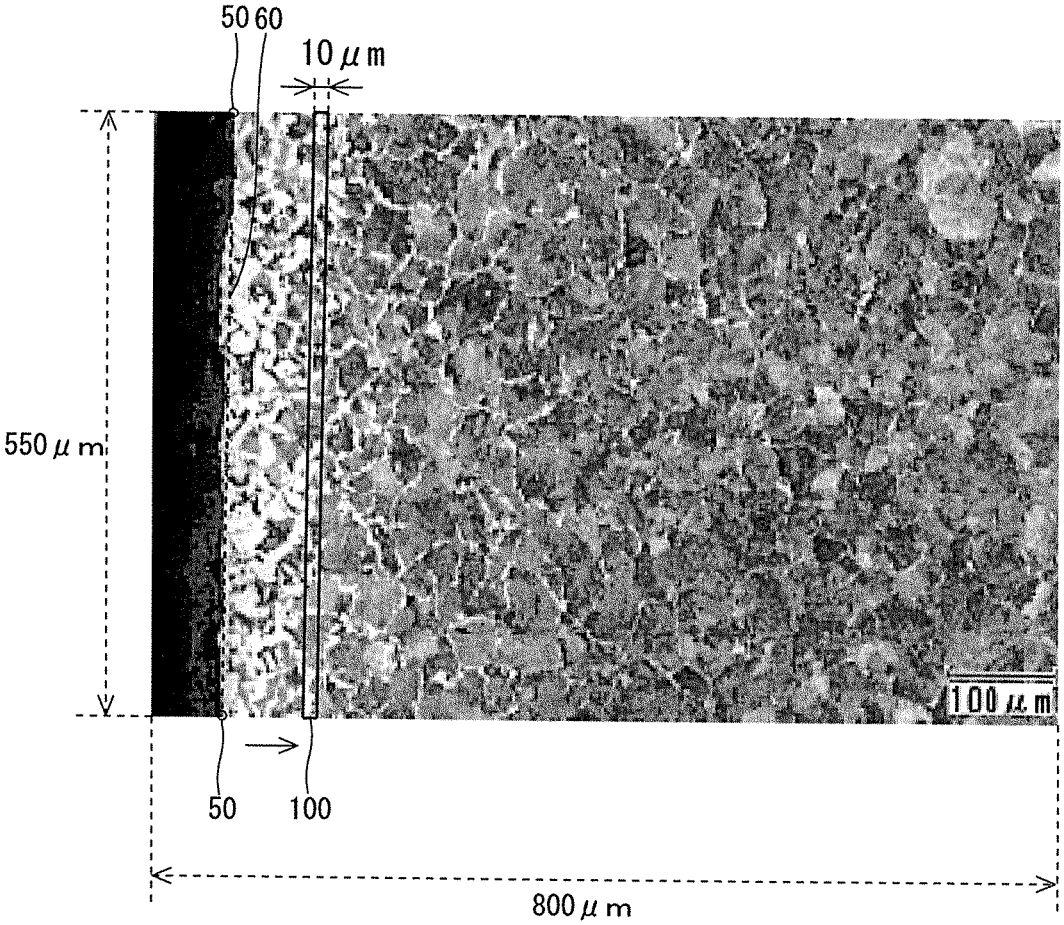
FIG. 6 is a photographic image for describing an example of a method for measuring a decarburization depth.

The decarburization depth of each of the round bars to which the test numbers were assigned was determined by the following method: The round bar was cut along a plane perpendicular to the axial direction of the round bar, and a micro-specimen having an inspection surface that coincides with the machined surface was collected. The surface of each of the micro-specimens was mirror-polished, and the polished surface was etched with a nital etching reagent. The etched surface was observed under an optical microscope at a magnification of 400. A photographic image of an arbitrary single field of view (800 μm×550 μm) of a surface portion including the surface of the round bar was formed. FIG. 6 shows an example of the formed photographic image.

The formed photographic image was used to determine the decarburization depth (μm) by the following method: The line (having length of 550 μm) connecting ends 50, which are opposite ends of the surface of the round bar in the photographic image, to each other was defined as a reference surface 60. A 10-μm-width measurement region 100 having two edges parallel to the reference surface 60 was provided. The measurement region 100 was moved by an increment of 1 μm from the reference surface 60 in the depth direction. The pro-eutectoid ferrite ratio in the measurement region 100 was calculated whenever the measurement region 100 was moved by 1 μm. The depth where the pro-eutectoid ferrite ratio was no longer 4% or more (distance from reference surface 60 to widthwise center of measurement region 100) was defined as the decarburization depth (μm). The "depth where the pro-eutectoid ferrite ratio was no longer 4% or more" means a depth below which the pro-eutectoid ferrite ratio is less than 4%.

[Results of Investigations]

Table 2 shows results of the investigations.

TABLE 2

| Test number | Interior separate from surface by 500 μm: Structure | Pro-eutectoid ferrite ratio (%) | Colony diameter (μm) | Interior separate from surface by 5 mm: Structure | Pro-eutectoid ferrite ratio (%) | Colony diameter (μm) | Average hardness (HV) | Fatigue strength (MPa) | Amount of wear (g) | Carburization depth (μm) | B + M area fraction (%) |
|---|---|---|---|---|---|---|---|---|---|---|---|
| 1 | P | 0 | 3.2 | P | 0 | 3.4 | 313 | 420 | 0.0071 | — | 0 |
| 2 | F + P | 1 | 3.6 | F + P | 2 | 3.9 | 303 | 400 | 0.0074 | 240 | 0 |
| 3 | F + P | 1 | 3.1 | F + P | 1 | 3.7 | 311 | 430 | 0.0073 | 190 | 0 |
| 4 | F + P | 1 | 3.3 | F + P | 2 | 3.9 | 308 | 410 | 0.0072 | — | 0 |
| 5 | F + P | I | 3.8 | F + P | 2 | 4.1 | 310 | 410 | 0.0073 | — | 0 |
| 6 | F + P | 1 | 3.9 | F + P | 2 | 4.1 | 302 | 400 | 0.0074 | — | 0 |
| 7 | F + P | 1 | 3.3 | F + P | 2 | 3.7 | 309 | 410 | 0.0072 | — | 0 |
| a | F + P | 7 | 4.5 | F + P | 8 | 4.4 | 285 | 405 | 0.0098 | — | 0 |
| b | F + P | 4 | 3.6 | F + P | 4 | 3.6 | 291 | 400 | 0.0086 | — | 0 |
| c | M | 0 | — | M | 0 | — | 561 | 620 | 0.0083 | — | 100 |
| d | F + P | 2 | 3.5 | F + P | 2 | 3.7 | 305 | 400 | 0.0074 | >600 | 0 |
| e | M + B + P | 0 | — | M + B + P | 0 | — | 451 | 530 | 0.0075 | — | 30 |
| f | F + P | 3 | 6.9 | F + P | 3 | 7.1 | 279 | 390 | 0.0079 | — | 0 |
| g | M + B + P | 1 | — | M + B + P | 1 | — | 461 | 540 | 0.0079 | — | 50 |
| h | F + P | 4 | 3.9 | F + P | 4 | 4.1 | 294 | 395 | 0.0082 | — | 0 |
| i | B + P | 0 | — | B + P | 0 | — | 431 | 490 | 0.0081 | — | 30 |

Table 2 shows the structure, the pro-eutectoid ferrite ratio, and the colony diameter associated with the round bar produced from each of the steel materials and observed in the depth position separate from the surface of the round bar by 500 μm and in the depth position separate from the surface by 5 mm.

The "Structure" fields each show the structure identified in the microstructure investigation. In Table 2, "F+P" represents the ferrite-pearlite structure, "P" represents the pearlite structure, "M" represents the martensite structure, "B+P" represents the bainite-pearlite structure, and "M+B+P" represents the martensite-bainite-pearlite structure. The "Pro-eutectoid ferrite ratio (%)" fields each show the average of the pro-eutectoid ferrite ratios in the micro-specimens collected at the four locations set at 90° intervals or in the 20 fields of view in total in the microstructure investigation. The "Colony diameter (μm)" fields each show the average of the colony diameters in the microstructures collected at the four locations set at 90° intervals in the microstructure investigation. "-" in Table 2 represents that no colony diameter was measured.

The "Average hardness (HV)" field shows the average of average hardness values associated with the micro-specimens collected at the four locations set at 90° intervals in the surface hardness investigation (that is, average of hardness values at 20 points in total). It is noted that average hardness less than 300 HV does not provide high fatigue strength. On the other hand, machining is difficult to perform when the average hardness is more than 400 HV.

The "Fatigue strength (MPa)" field shows the fatigue strength obtained in the fatigue strength investigation. The fatigue strength is preferably 400 MPa or more.

The "Amount of wear (g)" field shows the amount of wear obtained in the wear resistance test. The amount of wear is preferably 0.0080 g or less.

The "Carburization depth (μm)" field shows the carburization depth (μm) which is obtained in the carburization depth investigation and below which the pro-eutectoid ferrite ratio is less than 4%. The less-than-4% carburization depth is preferably less than 500 μm. "-" in Table 2 represents that no carburization depth was measured.

Figure 7:
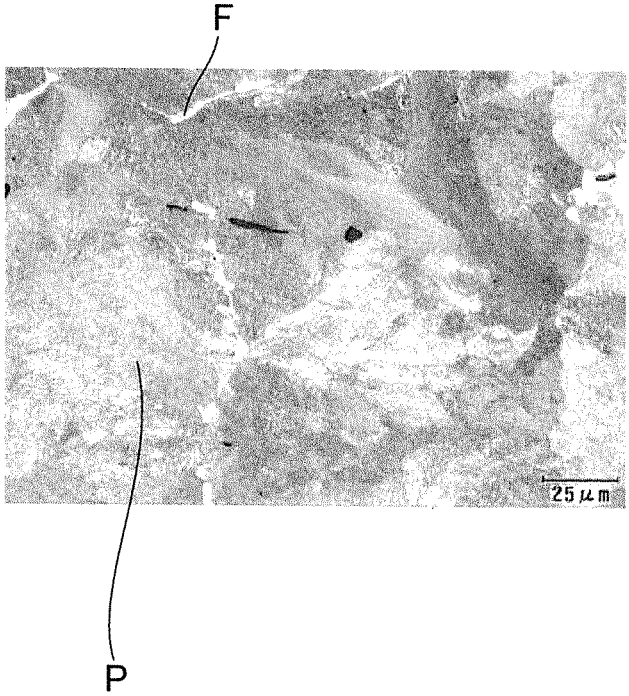
FIG. 7 is a microstructure photograph of a specimen material in an example of the present invention.

Referring to Table 1, the chemical compositions of the sample materials to which the test numbers 1 to 7 were assigned fell within the scope of the present invention, and the cooling rates after the hot forging were appropriate. Referring to Table 2, in the case of the test numbers 1 to 7, the structure in each of the depth position separate from the surface of each of the sample materials by 500 μm and the depth position separate from the surface by 5 mm was the ferrite-pearlite structure, in which a pro-eutectoid ferrite ratio is 3% or less or the pearlite structure. FIG. 7 is a microstructure photograph of the specimen material having the test number 2 in the position separate from the surface of the specimen material by 5 mm. Referring to FIG. 7, the majority of the microstructure was pearlite P, and the pro-eutectoid ferrite F had an area fraction of 2%. In the photograph of the structure in FIG. 7, the portion extending in the lateral direction is MnS.

Further, in the case of the test numbers 1 to 7, the colony diameter in the structure in each of the depth position separate from the surface of each of the sample materials by 500 μm and the depth position separate from the surface by 5 mm was 5.0 μm or less. As a result, in each of the test numbers 1 to 7, the fatigue strength was 400 MPa or more, and the amount of wear was 0.0080 g or less. The average hardness in each of the test numbers 1 to 7 was 300 HV or more. Further, the average hardness in each of the test numbers 1 to 7 was 400 HV or less, which provides excellent machinability. Moreover, the carburization depth in each of the test numbers 2 and 3 was less than 500 μm.

In the case of the test number a, the Mn content was small, and V was contained. Mn is an element that suppresses formation of ferrite, and V is an element that contributes to formation of ferrite. Therefore, in the case of the test number a, the structure in each of the depth position separate from the surface of the sample material by 500 μm and the depth position separate from the surface by 5 mm was the ferrite-pearlite structure, in which a pro-eutectoid ferrite ratio is more than 3%. As a result, the amount of wear associated with the test number a was more than 0.0080 g. The average hardness associated with the test number a was less than 300 HV.

In the case of the test number b, the C content was small. C is an element that suppresses formation of ferrite. Therefore, in the case of the test number b, the structure in each of the depth position separate from the surface of the sample material by 500 μm and the depth position separate from the surface by 5 mm was the ferrite-pearlite structure, in which a pro-eutectoid ferrite ratio is more than 3%. As a result, the amount of wear associated with the test number b was more than 0.0080 g. The average hardness associated with the test number b was less than 300 HV.

In the case of the test number c, the C content was small, the Mn content was also small, but the Cr content was large. Cr is an element that contributes to formation of martensite. Therefore, in the case of the test number c, the structure in each of the depth position separate from the surface of the sample material by 500 μm and the depth position separate from the surface by 5 mm was the martensite structure. Martensite and bainite tend to wear as compared with pearlite. As a result, the amount of wear associated with the test number c was more than 0.0080 g. The average hardness associated with the test number c was more than 400 HV.

The Si content associated with the test number d was high. The carburization depth was therefore large, the measurement of the carburization depth was performed down to a depth of 600 μm, which is the depth where an observable field of view is present, and the measurement was terminated there. The carburization depth was more than 600 μm.

The chemical composition in the case of the test number e was appropriate, but the cooling rate after the hot forging was too high. The structure in each of the depth position separate from the surface of the sample material by 500 μm and the depth position separate from the surface by 5 mm contained not only pearlite but martensite and bainite, in each of which an area fraction of about 30%. The average hardness associated with the test number e was therefore more than 400 HV.

The chemical composition in the case of the test number f was appropriate, but the cooling rate after the hot forging was too low. The colony diameter in the pearlite structure in each of the depth position separate from the surface of the sample material by 500 μm and the depth position separate from the surface by 5 mm was more than 5.0 μm. As a result, the fatigue strength associated with the test number f was less than 400 MPa.

The Cr content associated with the test number g was too high. The structure in each of the depth position separate from the surface of the sample material by 500 μm and the depth position separate from the surface by 5 mm contained not only pearlite but martensite and bainite. The average hardness associated with the test number i was therefore more than 400 HV.

In the case of the test number h, the Mn content was small. Mn is an element that suppresses formation of ferrite. Therefore, in the case of the test number h, the structure in each of the depth position separate from the surface of the sample material by 500 μm and the depth position separate from the surface by 5 mm was the ferrite-pearlite structure, in which a pro-eutectoid ferrite ratio is more than 3%. As a result, the amount of wear associated with the test number h was more than 0.0080 g. The average hardness associated with the test number h was less than 300 HV, and the fatigue strength was less than 400 MPa.

In the case of the test number i, the Mn content was too high. Mn is an element that contributes to formation of bainite. Therefore, in the case of the test number i, the structure in each of the depth position separate from the surface of the sample material by 500 μm and the depth position separate from the surface by 5 mm was the bainite-pearlite structure. Martensite and bainite tend to wear as compared with pearlite. As a result, the amount of wear associated with the test number i was more than 0.0080 g. Further, the average hardness associated with the test number i was more than 400 HV.

In the embodiment described above, the case where the hot forged product is a crankshaft has been described. The present invention is, however, also applicable to a hot forged product other than a crankshaft.

The embodiment of the present invention has been described above, but the embodiment described above is merely an example for implementation of the present invention. The present invention is therefore not limited to the embodiment described above, and the embodiment described above can be changed as appropriate to the extent that the change does not depart from the substance of the present invention and implemented in the changed form.

The invention claimed is:

1. A hot forged product having a chemical composition consisting of, in mass %,
C: 0.45 to 0.70%,
Si: 0.01 to 0.70%,
Mn: 1.0 to 1.7%,
S: 0.01 to 0.1%,
Cr: 0.05 to 0.25%,
Al: 0.003 to 0.050%,
N: 0.003 to 0.02%,
Ca: 0 to 0.01%,
Cu: 0 to 0.15%, and
Ni: 0 to 0.15% with the balance being Fe and impurities,
wherein a matrix at a depth of 500 μm to 5 mm from an unmachined surface of the forged product is a ferrite-pearlite structure, in which a pro-eutectoid ferrite area fraction is 3% or less or a pearlite structure,
an average diameter of pearlite colonies in the pearlite structure at the depth of 500 μm to 5 mm from the unmachined surface is 5.0 μm or less, and
the hot forged product exhibits a wear resistance,
wherein an amount of wear is less than or equal to 0.0080 g when a specimen having a size of 1.5 mm by 2.0 mm by 3.7 mm is subjected to a pin-on-disk wear test.

2. The hot forged product according to claim 1,
wherein the chemical composition contains, in mass %,
Ca: 0.0005 to 0.01%.

3. The hot forged product according to claim 2,
wherein the chemical composition contains, in mass %, at least one selected from a group consisting of
Cu: 0.02 to 0.15%, and
Ni: 0.02 to 0.15%.

4. The hot forged product according to claim 3,
wherein the hot forged product is a crankshaft.

5. The hot forged product according to claim 2,
wherein the hot forged product is a crankshaft.

6. The hot forged product according to claim 1,
wherein the chemical composition contains, in mass %, at least one selected from a group consisting of
Cu: 0.02 to 0.15%, and
Ni: 0.02 to 0.15%.

7. The hot forged product according to claim 6,
wherein the hot forged product is a crankshaft.

8. The hot forged product according to claim 1,
wherein the hot forged product is a crankshaft.

9. The hot forged product according to claim 1,
wherein the hot forged product exhibits a fatigue strength of greater than 400 MPa
wherein a test bar of the hot forged product having a round cross-section formed from a parallel section of the hot forged alloy has a diameter of 8 mm and opposing grip sections each having a diameter of 12 mm.

* * * * *